US006532868B2

(12) United States Patent
Kaneda et al.

(10) Patent No.: US 6,532,868 B2
(45) Date of Patent: Mar. 18, 2003

(54) STENCIL MAKING AND PRINTING SYSTEM, CONTROL METHOD, AND STENCIL MAKING AND PRINTING MACHINE

(75) Inventors: Hirotaka Kaneda, Ibaraki-ken (JP); Manabu Iwamoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/915,277

(22) Filed: Jul. 27, 2001

(65) Prior Publication Data

US 2002/0035935 A1 Mar. 28, 2002

(30) Foreign Application Priority Data

Aug. 10, 2000 (JP) ..... 2000-242867

(51) Int. Cl.[7] ..... B41C 1/14

(52) U.S. Cl. ..... 101/128.4

(58) Field of Search ..... 101/114, 128.21, 101/128.4, 129, 401.1

(56) References Cited

U.S. PATENT DOCUMENTS 6,401,607 B2 * 6/2002 Yoneoka ..... 101/128.4
6,427,589 B2 * 8/2002 Watanabe ..... 101/128.4

FOREIGN PATENT DOCUMENTS

JP 08-142470 * 6/1996

* cited by examiner

*Primary Examiner*—Stephen R. Funk
(74) *Attorney, Agent, or Firm*—Gary M. Nath; Harold L. Novick; Jerald L. Meyer

(57) ABSTRACT

A stencil making and printing machine outputs a busy signal indicative that the stencil making and printing machine is a busy state, and then, gives the busy signal as an answer to the external computer system via the controller for a predetermined time after the stencil making process and for a predetermined time after a printing process, and thereby, an intervention operation from the external computer system is limited. By doing so, the present invention provides a stencil making and printing system and a stencil making and printing machine, which can improve an operability of stencil making and printing process, and has a high processing efficiency.

12 Claims, 9 Drawing Sheets

STENCIL MAKING AND PRINTING SYSTEM, CONTROL METHOD, AND STENCIL MAKING AND PRINTING MACHINE

CROSS REFERENCE TO RELATED APPLICATIONS

This application claims benefit of priority under 35 USC §119 to Japanese Patent Application No. 2000-242867 filed on Aug. 10, 2000, the entire contents of which are incorporated by reference herein.

BACKGROUND OF THE INVENTION

1. Field of the Invention

The present invention pertains to a stencil making and printing system, a control method thereof, and a stencil making and printing machine, which perform a stencil making and printing process in an on-line mode or off-line mode.

2. Description of the Related Art

Conventionally, there is a stencil making and printing machine including an original reading section, a stencil writing section and a printing section, which are integrally constructed. In such a stencil making and printing machine, the original prepared as a paper medium by user's operation is read, and then, a stencil making and printing process for an original image reading the original is performed. The stencil making and printing machine performs the above stencil making and printing process in the independent form.

On the other hand, a method has been employed such that the stencil making and printing machine and a computer system such as personal computer are connected via an interface system such as a controller or the like. A user prepares a digital original by application built in the computer system, and thereafter, transmits it to the stencil making and printing machine by remote control so that the stencil making and printing process can be performed.

As described above, the stencil making and printing machine performs the stencil making and printing process of the original image reading the original in the independent form; in this case, the above method is called as an "off-line mode". On the other hand, the stencil making and printing machine receives the digital original from the computer system, and then, performs the stencil making and printing process of the digital original; in this case, the above method is called as an "on-line mode". As shown in FIG. 1, the user properly makes a selection of processing mode of the stencil making and printing machine, using on-line/off-line selection means such as a mode selection key provided on the stencil making and printing machine.

As described above, the stencil making and printing system is constructed in a manner that the stencil making and printing machine has two modes, that is, off-line mode and on-line mode; however, the stencil making and printing system has the following technical problem to be solved.

FIG. 2A shows a time chart of stencil making and printing process by a conventional stencil making and printing system.

At the time T101, the user changes a mode of the stencil making and printing machine into an off-line mode by the mode selection key, and then, makes a necessary operation with respect to a control panel on the stencil making and printing machine. Thereafter, at the time T102, the stencil making and printing machine starts a stencil making process in the off-line mode. At the time T103, the stencil making process ends, and then, the user confirms one trial print (first print) outputted by the above stencil making process. At the time T104, when the confirmation of the trial print is completed, subsequently, the stencil making and printing machine starts a printing operation, and then, the printing process is carried out by the time T105.

In this case, during the following period, the stencil making and printing machine outputs a busy signal indicative that it is busy (operating mode), to its internal computer system and an external computer system, and thereby, an intervention operation by other stencil making and printing job is limited. The period includes the panel operation from the time T101 to T102, the off-line stencil making process from the time T102 to T103 and the off-line printing process from the time T104 to T105.

However, for the period (time T103 to T104) when the user confirms the trial print, the stencil making and printing machine becomes a standby mode, and the busy signal is an off state; for this reason, the intervention by other stencil making and printing job is possible. One example of the intervention is shown in FIG. 2B.

In FIG. 2B, after the stencil making process by the off-line mode ends, at the time T109 when the user is confirming the trial print outputted in the stencil making process, another user starts an on-line stencil making process by remote control.

In this case, the user, who is confirming the trial print, intends to carry out an off-line printing process after the confirmation is completed; nevertheless, an interruption is made by other job. As a result, the user must wait until the interrupted other job is finished. In addition, a (master) stencil made for the time T102 to T103 is discharged into a stencil disposal box in a stencil making process by other user from the time T109; for this reason, the user must try the stencil making process again.

As described above, in the stencil making and printing system constructed in a manner that the stencil making and printing machine has two modes, that is, off-line mode and on-line mode, the stencil making and printing job processing at present is interrupted by another stencil making and printing job; as a result, a processing efficiency becomes worse.

SUMMARY OF THE INVENTION

The present invention has been made in view of the above problem in the related art. Therefore, an object of the present invention is to provide a stencil making and printing system, a control method thereof, and a stencil making and printing machine, which can improve an operability in a stencil making and printing process, and has a high processing efficiency.

In order to achieve the above object, according to a first aspect of the present invention, there is provided a stencil making and printing system, which transmits a print information from an external computer system to a stencil making and printing machine via a controller, and carries out a stencil making process and a printing process based on the transmitted print information by remote control from the external computer system in the stencil making and printing machine, wherein the stencil making and printing machine limit an intervention operation from the external computer system by outputting a busy signal indicative that the stencil making and printing machine is a busy state, and giving the busy signal as an answer to the external computer system via the controller for a predetermined time after the stencil making process and for a predetermined time after a printing process.

With the above construction, for the predetermined time after the stencil making process and the printing process, the stencil making and printing machine becomes a busy state. Therefore, it is possible to prevent an interruption by the intervention operation from the external computer system by another user.

Further, according to a second aspect of the present invention, there is provided a stencil making and printing system, which has an on-line mode of transmitting a print information from an external computer system to a stencil making and printing machine via a controller, and carrying out a stencil making process and a printing process based on the transmitted print information by remote control from the external computer system in the stencil making and printing machine, and an off-line mode of reading an original by an original reading section included in the stencil making and printing machine, and carrying out a stencil making process and a printing process based on a read print information in the stencil making and printing machine, wherein the stencil making and printing machine generates the signals of: an internal busy signal indicative that internal units of the stencil making and printing machine is a busy state; a timer busy signal indicative that the stencil making and printing machine is a busy state for a predetermined time after the stencil making process and for a predetermined time after the printing process; an external busy signal generated by the logical sum of the internal and timer busy signals, and further, limits an operator intervention in the off-line mode by the internal busy signal, and limits an intervention operation from the external computer system by the external busy signal being given as an answer via the controller.

With the above construction, in the stencil making and printing system having the on-line mode and the off-line mode, for the predetermined time after the stencil making process and the printing process, the stencil making and printing machine becomes a busy state to the external computer system. Therefore, it is possible to prevent an interruption by the intervention operation from the external computer system by another user, and further, to carry out the intervention operation by the off-line mode in the same manner as the conventional case.

Further, there is provided the stencil making and printing system, wherein the stencil making and printing machine is shifted to the off-line mode in the case where an original detection means included in the original reading section makes a detection that the original is set on the original reading section.

As described above, the detection that the original is set is made, and the process mode is automatically changed, and thereby, the stencil making and printing machine is easy to handle, and it is possible to perform stencil making and printing process at a high processing efficiency.

Other objects, features and effects of the present invention will be further apparent from the following detailed description made with reference to the accompanying drawings.

DETAILED DESCRIPTION OF THE PREFERRED EMBODIMENTS

Hereinafter, one embodiment of the present invention will be described with reference to the accompanying drawings.

Figure 3:
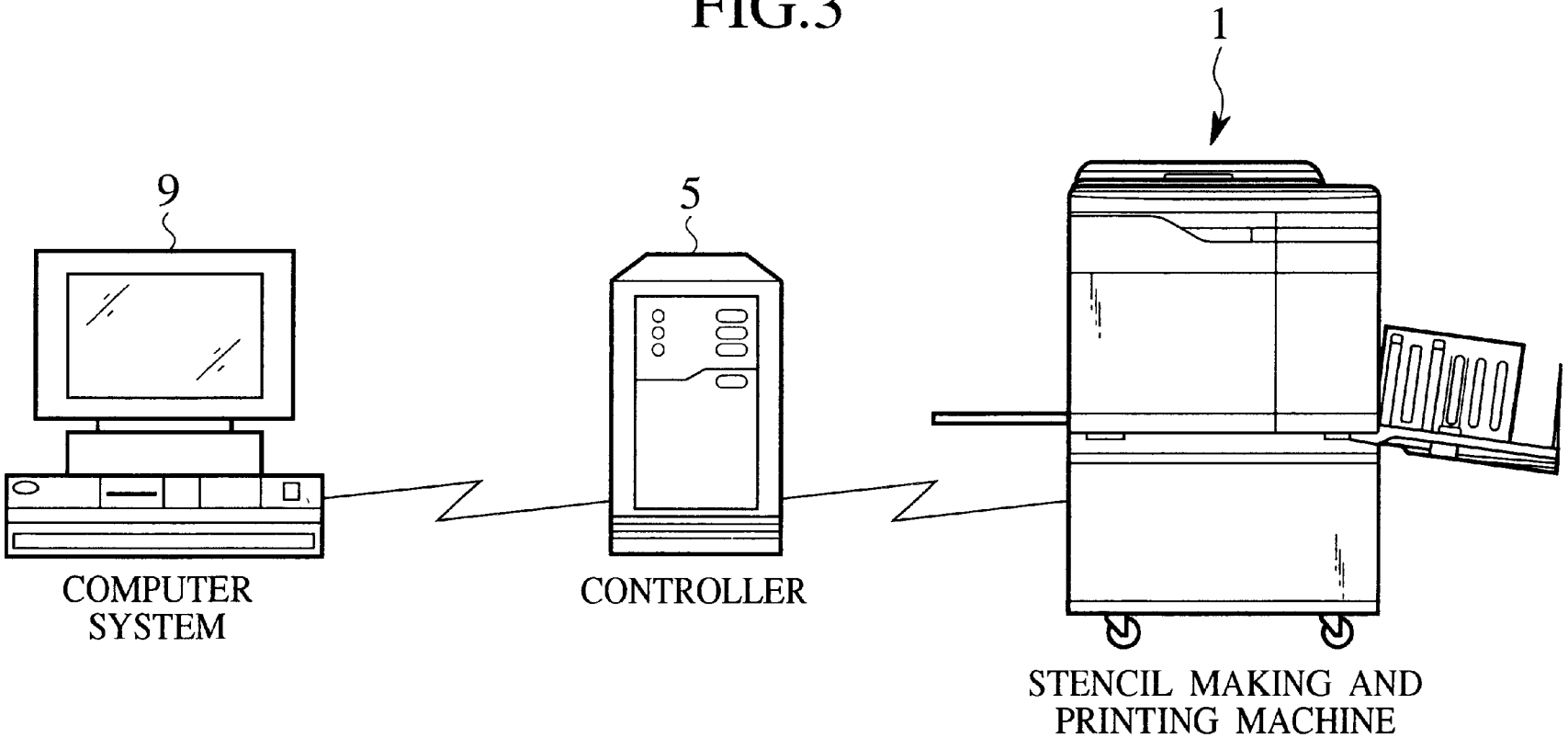
FIG. 3 is a schematic view showing a configuration of a stencil making and printing system according to one embodiment of the present invention.

FIG. 3 is a schematic view showing a configuration of a stencil making and printing system according to the embodiment of the present invention. As shown in FIG. 3, the stencil making and printing system is constructed in a manner that a controller 5, which functions as an interface, is electrically connected between a stencil making and printing machine 1 and an external computer system 9 via a communication line.

In this case, the external computer system 9 and the controller 5, which are positioned at a remote place, may be connected by a telephone line via a modem or the like. Further, a plurality of the external computer systems 9 and the controller 5 may be connected via a LAN (Local Area Network) or WAN (Wide Area Network).

The controller 5 is a device for controlling transmission and reception of print information and control information between the stencil making and printing machine 1 and the external computer system 9. In this case, the controller 5 may be built in the stencil making and printing machine 1 or the external computer system 9.

Figure 4:
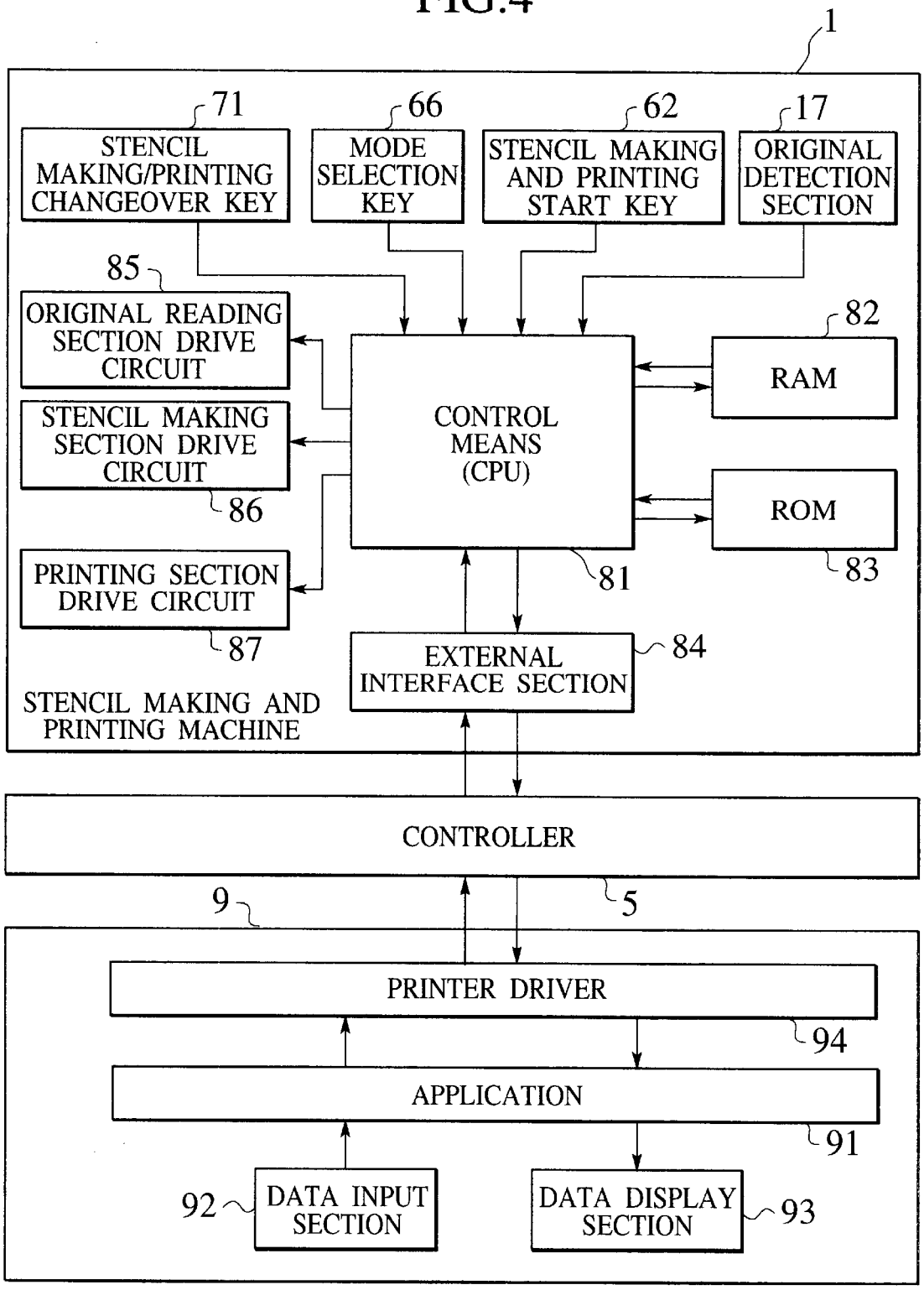
FIG. 4 is a control block diagram in the stencil making and printing system shown in FIG. 3.

FIG. 4 is a diagram showing a functional block of the stencil making and printing system. As shown in FIG. 4, the stencil making and printing machine 1 has control means (CPU) 81 for controlling the entirety of machine, a RAM 82 for storing information inputted from a control panel and information transmitted from the external computer system 9, and a ROM 83 for storing a control program or the like, a stencil making/printing selection key 71, a mode selection key 66, a stencil making and printing start key 62, and an original detection section 17 for detecting the presence of the original set on an original reading section, external interface 84 for carrying out transmission and reception with the external computer system 9 via the controller 5, an original reading section drive circuit 85 for driving and controlling an original reading section 10, a stencil making section drive circuit 86 for driving and controlling a stencil writing section 20, and a printing section drive circuit 87 for driving and controlling a printing section 40.

The control means 81 generates various control signals according to the control program stored in the ROM 83, and controls internal units of the stencil making and printing machine 1 and the external computer system 9. Various control signals are an internal busy signal of the stencil making and printing machine 1, a timer busy signal, an external output busy signal, etc. These controls signals will be described in detail below.

The external computer system 9 has applications 91 such as a document processing program, an image processing program or the like, a printer driver 94, a data input section 92, and a data display section 93. The printer driver 94 converts a digital original data comprising characters and images processed by the application 91 into a data interpretable by the stencil making and printing machine 1, and then, transmits the digital original data to the stencil making and printing machine 1 while considering the status of the machine 1. The data input section 92 inputs a data, instruction and the like to the application 91 and the printer driver 94. The data display section 93 displays a data from the application 91 and the printer driver 94.

Figure 5:
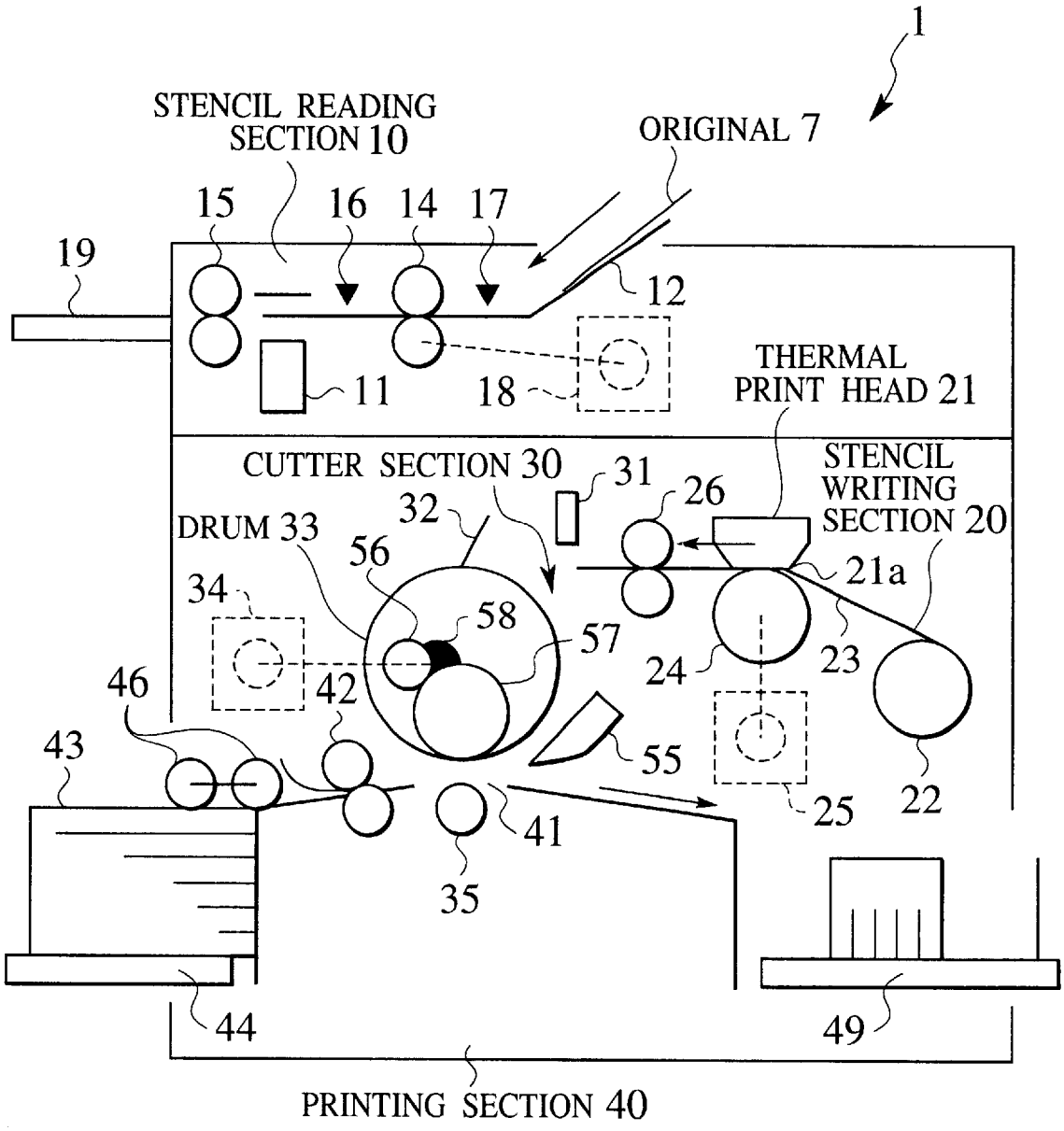
FIG. 5 is a side sectional view showing one embodiment of a stencil making and printing machine constituting the stencil making and printing system shown in FIG. 3.

FIG. 5 is a side sectional view showing the above stencil making and printing machine 1 according to one embodiment of the present invention. The stencil making and printing machine 1 is composed of a stencil reading section 10, which is an original reading section, a stencil writing section 20, which is an original image writing section, a cutter section 30, and a printing section 40, which is a copying section.

The stencil reading section 10 is a unit for carrying out a stencil making process by the off-line mode, and is composed of an original set tray 12, an original sensor 17 functioning as original detection means, an original fed roller pair 14, a contact type image sensor 11, and an original discharge roller pair 15. An original 7 to be copied is set on the original set tray 12. The original sensor 17 is original detection means for detecting the presence of original 7 set on the original set tray 12. The original feed roller pair 14 is driven according to a detection signal of the original sensor 17 so as to feed the original 7 set on the original set tray 12. The image sensor 11 optically reads (scans) an image of the original 7 thus fed, and thereafter, converts the image into an electric signal. The original discharge roller pair 15 discharges the original 7 read by the image sensor 11 to an original discharge tray 19.

In this case, an original IN sensor 16 detects the original 7 thus fed, and thereby, determines a start of the stencil writing section 20 described below.

These original feed roller pair 14 and original discharge roller pair 15 are rotated and driven by a stepping motor 18 shown by a dotted line in FIG. 5.

The stencil writing section 20 is composed of a thermal print head 21 having a plurality of heat elements 21*a*, a platen roller 24, and a stencil sheet feed roller pair 26. The platen roller 24 feeds a stencil sheet 23 fed from a stencil sheet roll 22 while abutting is against the thermal print head 21. The stencil sheet feed roller pair 26 feeds the stencil sheet 23 made by the thermal print head toward a clamp section 32 of a drum 33 described alter.

Moreover, in FIG. 5, a writing motor 25 shown by a dotted line is a stepping motor, and rotates and drives the platen roller 24 and the stencil sheet feed roller pair 26.

The cutter section 30 includes a cutter 31 for cutting the stencil sheet 23 when the stencil sheet 23 made by the thermal print head 21 becomes a predetermined length after being wound around the drum 33.

The printing section 40 is composed of a drum 33, a pickup roller 46, a timing roller 42, a press roller 35, a separator pawl 55 and a stencil receiving tray 49. The drum 33 has a built-in ink supply section for supplying a predetermined amount of ink to its inner surface from an ink pool 58 formed between a doctor roller 56 and a squeeze roller 57. The pickup roller 46 picks up a print paper 43 one by one from a sheet to be copied, that is, a print paper placed on a paper feed tray 44, and then, feeds it. The timing roller 42 feeds the print paper 43 fed from the pickup roller 46 at a predetermined timing. The press roller 35 presses the print paper 43 fed from the timing roller 42 against an outer surface of the drum 33. The separator pawl 55 takes the print paper 43 thus printed out of the drum 33. Then, the print paper 43 taken and discharged from the drum 33 is placed on the stencil receiving tray 49.

The drum 33 is provided with a clamp section 32, which clamps the distal end of the stencil sheet 23 made and fed by the thermal print head 21, at its out surface. After being clamped, the made stencil sheet 23 is wound around the outer surface of the drum 33 by rotating the drum 33.

Moreover, in FIG. 5, a main motor 34 shown by a dotted line is a DC motor, and rotates and drives the drum 33. Further, a reference numeral 41 denotes a transport path.

Figure 6:
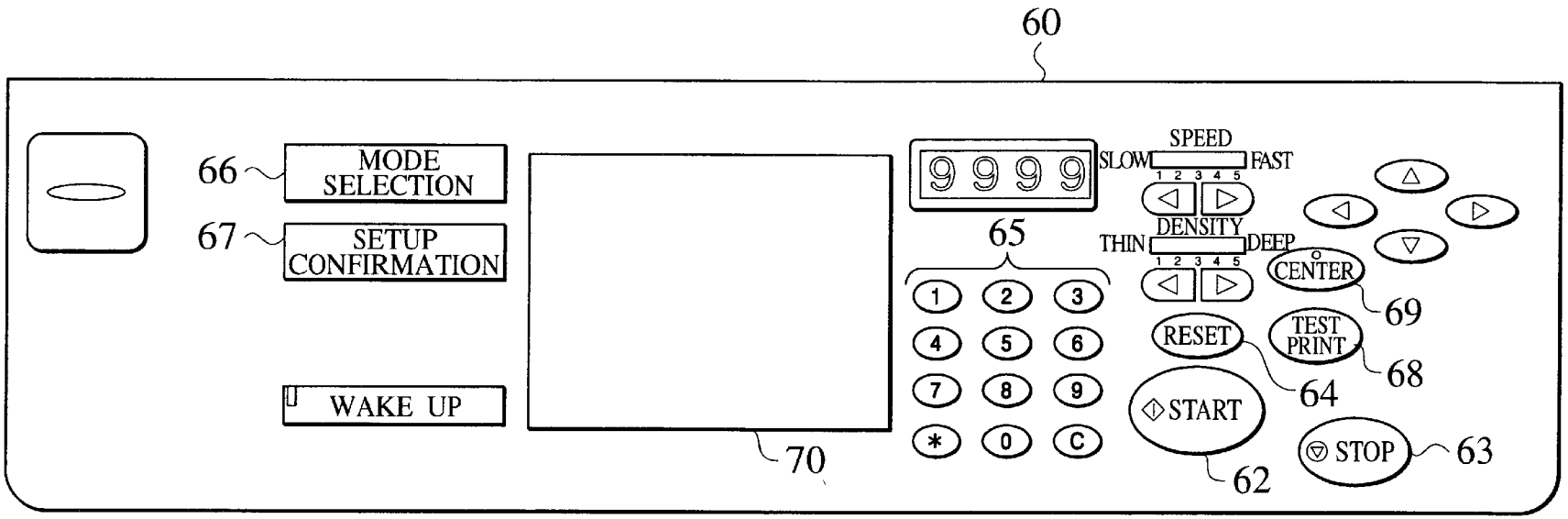
FIG. 6 is an imaging view showing a control panel of the stencil making and printing machine shown in FIG. 5.

Further, the above stencil making and printing machine 1 is provided with a control panel 60 as shown in FIG. 6. The control panel 60 has a start key 62, a stop key 63, a reset key 64, a ten key 65, a mode selection key 66, a setup confirmation key 67, a trial print key 68, a center key 69, and the like. The start key 62 is a key for starting a stencil making or printing process by the off-line mode. The stop key 63 is a key for stopping the stencil making or printing process. The reset key 64 is a key for resetting items set by the control panel 60. The ten key 65 is a key for inputting the number of print sheets or the like. The mode selection key 66 is a key for making a selection of on-line mode/off-line mode. The setup confirmation key 67 is a key for displaying items set by the control panel 60. The trial print key 68 is a key for carrying out a trial print in stencil making process. The center key 69 is a key for centering a print position.

Further, the control panel 60 is provided with a pressure sensitive or electrostatic touch panel 70, and a user directly touches the touch panel 70 by finger so as to input various parameters.

Figure 7:
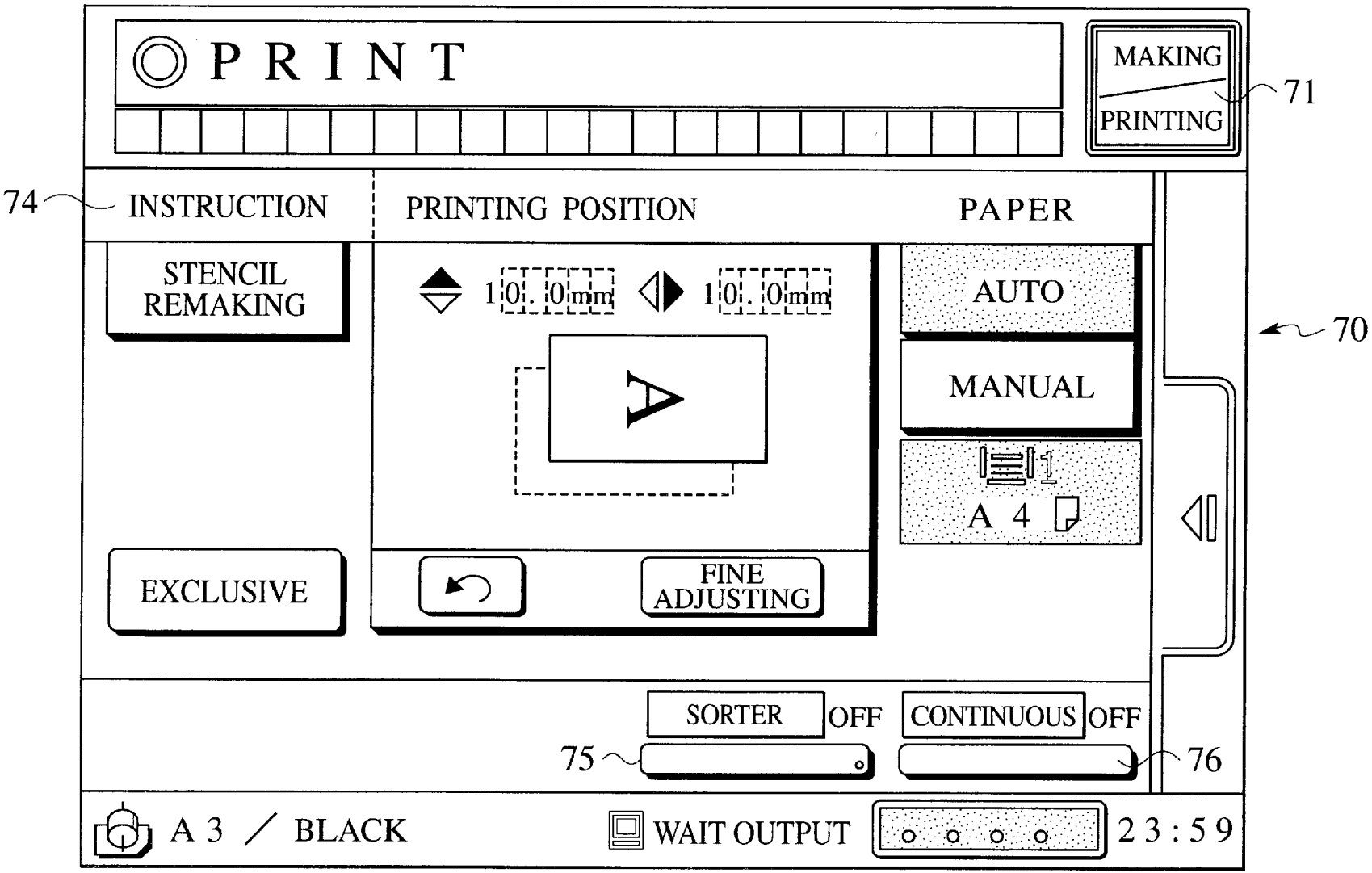
FIG. 7 is an imaging view showing an example displayed on a touch panel section of the control panel shown in FIG. 6.

In the case of carrying out the stencil making or printing process by the off-line mode, a setup input screen as shown in FIG. 7 is displayed on the touch panel 70. On the setup input screen, a stencil making/printing selection button 71, a sorter function setup button 75, a series/continuous print function setup button 76 and the like are arranged.

Next, the following is a detailed description on an operation of the stencil making and printing process of the stencil making and printing system.

As described above, the control means 81 of the stencil making and printing machine 1 generates various control signals according to the control program stored in the ROM 83 according to the status of the stencil making and printing machine 1, and then, controls the internal units of the stencil making and printing machine 1 and the external computer system 9. In this case, the control signals are as follows.

(1) Internal busy signal (2) Timer busy signal (3) External busy signal

Figure 1:
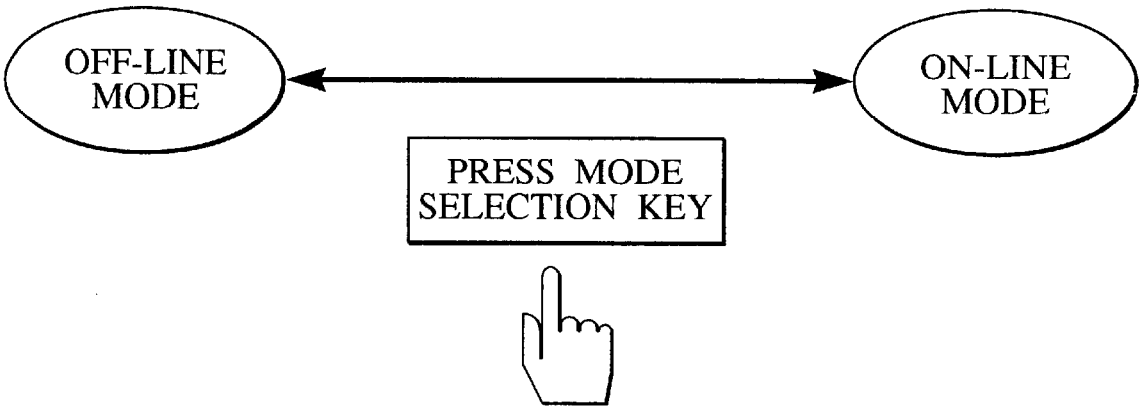
FIG.1 RELATED ART
FIG. 1 is a view to explain a selection of on-line/off-line mode in a conventional stencil making and printing system.
Figure 2A:
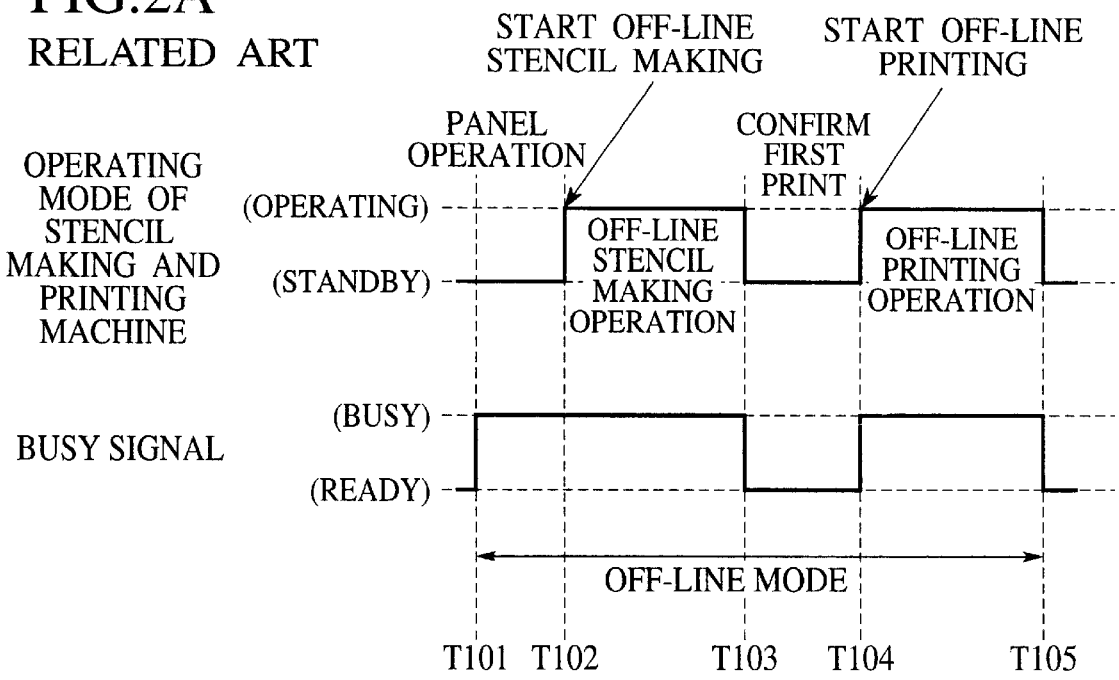
FIG.2A RELATED ART
FIG. 2A is a time chart showing a generation timing of busy signal in the conventional stencil making and printing system, and shows a stencil making and printing process by off-line mode.
Figure 2B:
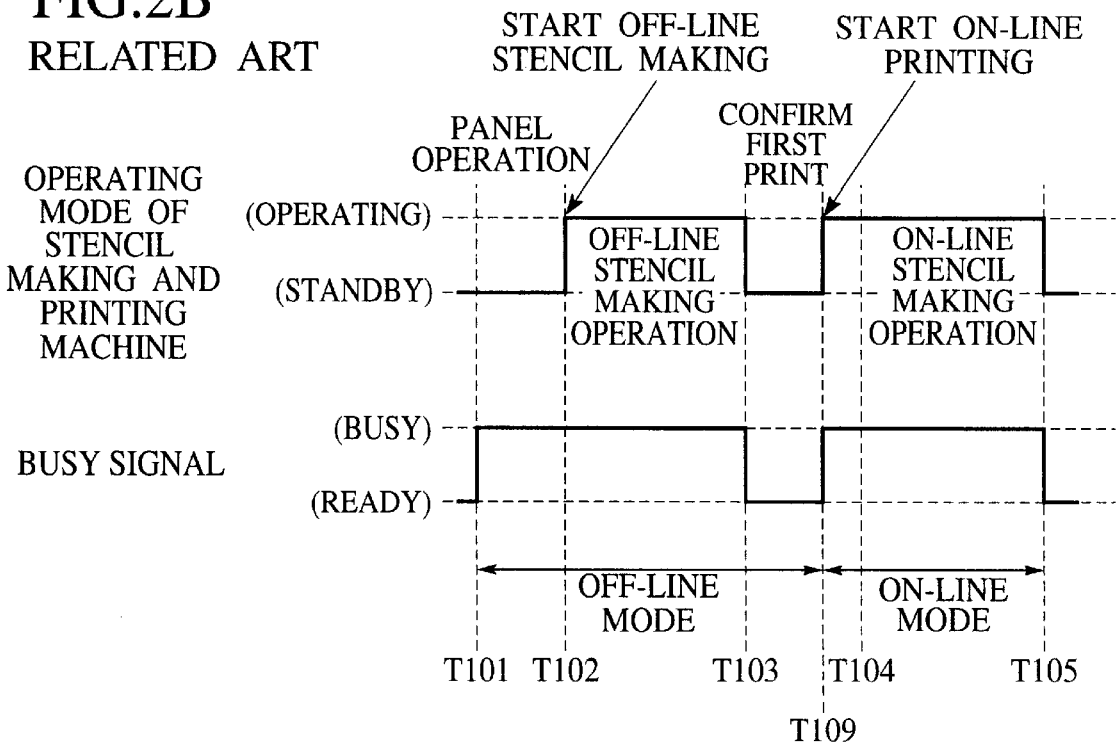
FIG.2B RELATED ART
FIG. 2B is a time chart showing a generation timing of busy signal in the conventional stencil making and printing system, and shows the case where the stencil making and printing process by the off-line mode is interrupted by a stencil making process by on-line mode.

The internal busy signal is a control signal outputted according to the status of drive unit such as the control panel 60, the stencil reading section 10, the stencil writing section 20, the printing section 40 of the stencil making and printing machine 1. Further, the internal busy signal controls a stencil and printing process by the off-line mode according to user's intervention operation. In this case, the internal busy signal is the same signal as used in the conventional stencil making and printing machine shown in FIG. 2A and FIG. 2B.

The timer busy signal is a signal for setting the status of the stencil making and printing machine 1 to a "pseudo operation mode" for a predetermined time after the stencil making and printing process is made.

The external busy signal is a signal for outputting the status of the stencil making and printing machine 1 to the external computer system 9 via the controller 5. Further, the external busy signal is generated by a logical sum of the above internal and timer busy signals, as shown in the following Table 1.

TABLE 1

| Internal busy signal | Timer busy signal | External busy signal |
|---|---|---|
| ON | ON | ON |
| ON | OFF | ON |
| OFF | ON | ON |
| OFF | OFF | OFF |

More specifically, if one of the busy signal and the timer busy signal is an "ON" state, the external busy signal becomes an "ON" state. If the busy signal and the timer busy signal are both an "OFF" state, the external busy signal becomes an "OFF" state.

The state shown by the three control signals is as follows.

(1) "ON": "BUSY (operating)"

(2) "OFF": "READY (standby)"

Figure 9:
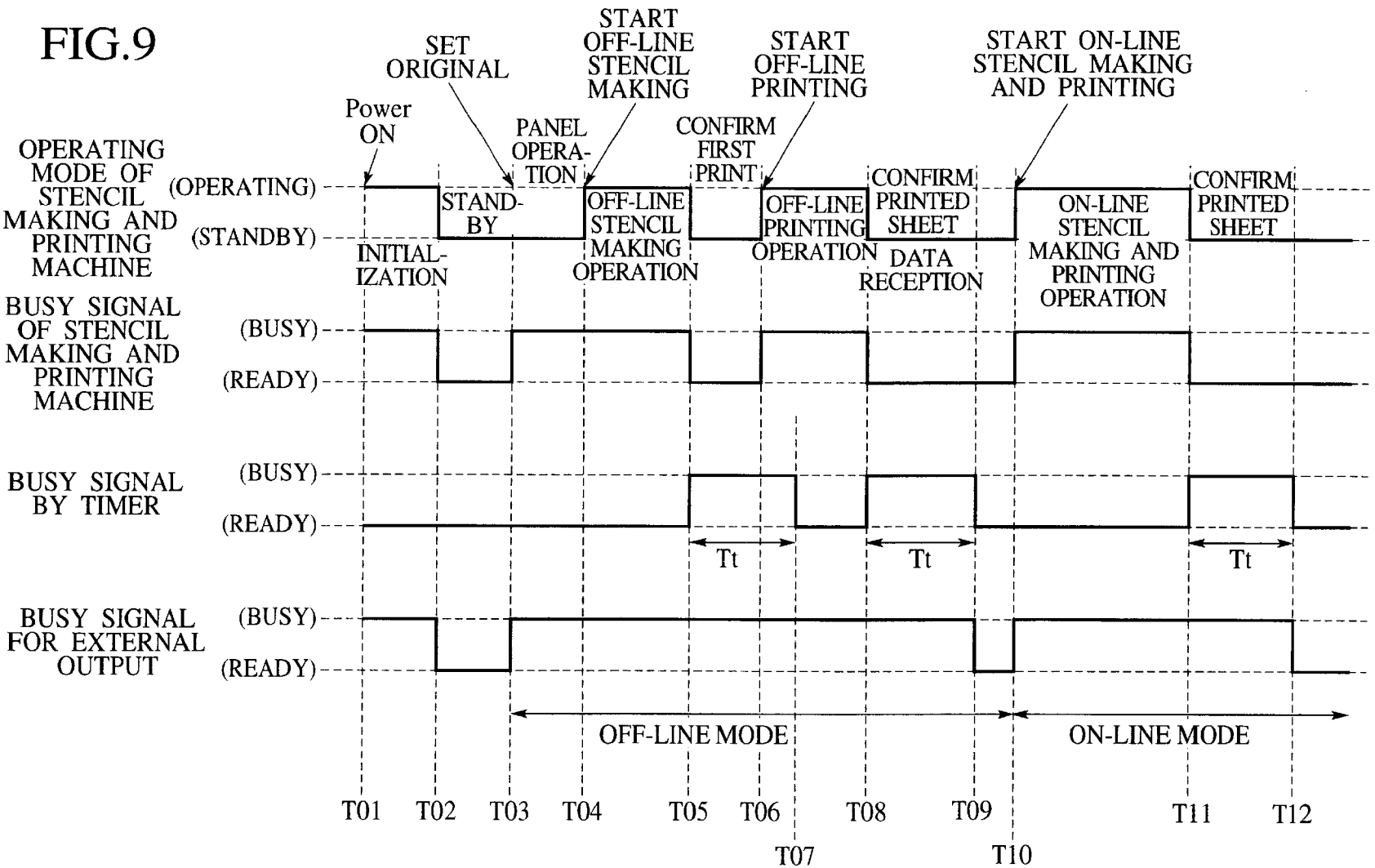
FIG. 9 is a time chart showing a generation timing of busy signal in the stencil making and printing system according to one embodiment of the present invention.

The operation by these control signals will be described below with reference to a time chart shown in FIG. 9. In FIG. 9, first, when the user turns "ON" a power switch of the stencil making and printing machine 1 at the time T01, the stencil making and printing machine 1 carries out the initial process such as clear of the RAM 82, error diagnosis by the time T02. For the duration from the time T01 to T02, the status of the stencil making and printing machine 1 is initializing; for this reason, the internal and external busy signals both become an "ON" state. Thus, the stencil making and printing machine 1 accepts neither the stencil making and printing process by the off-line mode nor the stencil making and printing process by the on-line mode.

At the time T02, when initialization is completed, the status of the stencil making and printing machine 1 is "standby", and all busy signals become an "OFF" state. Therefore, the stencil making and printing machine 1 can accept an intervention operation by the on-line mode or off-line mode.

Figure 8:
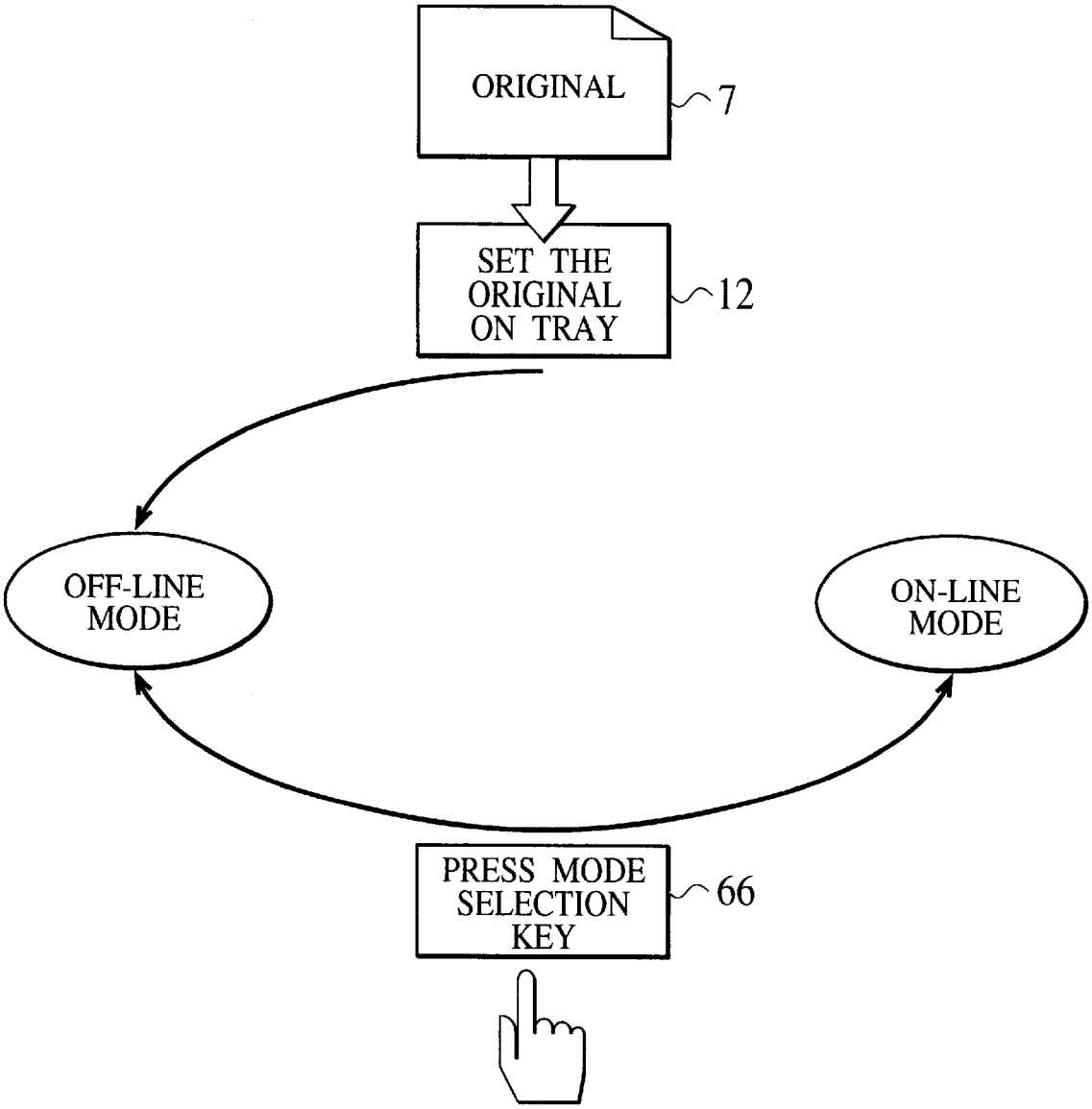
FIG. 8 is a view to explain a selection of on-line/off-line mode in the stencil making and printing system according to one embodiment of the present invention.

Subsequently, at the time T03, the user starts an intervention operation by the off-line mode. In the case of starting the intervention operation by the off-line mode, a mode of the stencil making and printing machine 1 must be changed into the off-line mode. As described above, conventionally, the mode selection key provided on the stencil making and printing machine 1 has been pressed so as to make a selection of on-line mode/off-line mode. On the contrary, in this embodiment, as shown in FIG. 8, in addition to the above conventional method, when the user sets the original 7 prepared as a paper medium on the stencil reading section 10 of the stencil making and printing machine 1, the mode is controlled so as to be automatically changed into the off-line mode. More specifically, when the original 7 is set on the original set tray 12 on the stencil making and printing machine 1, the original sensor 17 detects this operation, and then, generates a detection signal. The control means 81 makes use of the detection signal, and then, changes the process mode of the stencil making and printing machine 1 into the off-line mode when the detection signal is generated. As described above, a detection that the original 7 has been set is made, and then, the process mode is automatically changed. Therefore, the stencil making and printing machine 1 is easy to handle, and it is possible to perform a stencil making and printing process having a high processing efficiency. In this case, the user presses the mode selection key 66, and thereby, the selection of the on-line/off-line mode can be made by manual like the conventional case.

Referring again to the time chart shown in FIG. 9, at the time T03, when the user sets the original 7 prepared as a paper medium on the stencil reading section 10 of the stencil making and printing machine 1, as described above, the mode of the stencil making and printing machine 1 is automatically changed into the off-line mode.

Subsequently, the user inputs various parameters required for making a stencil by the setup of the control panel 60 on the stencil making and printing machine 1. For the duration when the setup of the control panel 60 is carried out (time T03 to T04), the status of the stencil making and printing machine 1 is a "panel operation". Therefore, the internal busy signal and the external busy signal are both an "ON" state.

At the time T03, when finishing the setup of the control panel 60, finally, the user presses the stencil making and printing selection button 71 so that the mode can be changed into the stencil making mode. Further, the user presses the start key 62, and thereby, the stencil making operation by the off-line mode is started. For the duration of the "stencil making operation" (time T04 to T05). Therefore, the internal busy signal and the external busy signal are both an "ON" state.

At the time T05, when the stencil making process by the off-line mode is completed, the internal busy signal becomes an "OFF" state. However, the timer busy signal becomes an "ON" state for a predetermined time (Tt) in place of the internal busy signal. Therefore, the external busy signal is maintained as it is "ON" state. By doing so, after the stencil making process is completed, it is possible to limit an intervention operation by the on-line mode from the external computer system for the duration when the user confirms the trial print (first print).

The external busy signal is an "ON" state, and when another user tries to make an intervention by remote control from the external computer system 9, the stencil making and printing machine 1 outputs an information indicative of "operating" to the external computer system 9 via the controller 5. The external computer system 9 receives the information via the printer driver 94, and then, informs the user of it.

The generation time (Tt) of the timer busy signal should be set to a sufficient time required for the user's confirmation of the trial print. For example, it is preferably 10 to 20 seconds. If the time T07 goes by, the timer busy signal becomes an "OFF" state. If the time T07 elapses before time T06, the intervention is possible by remote control from user's external computer system 9.

At the time T06 on the midway of the generation time (Tt) of the timer busy signal, when finishing the trial print, the user presses the stencil making/printing selection button 71 so as to change the mode into the printing mode. Further, the user presses the start key 62 so that the printing operation by the off-line mode can be started. For the duration from the time T05 to T06, the internal busy signal is an "OFF" state. Therefore, the intervention operation by the off-line mode is possible.

At the time T08, when the printing process by the off-line mode is completed, the internal busy signal again becomes an "OFF" state. However, the timer busy signal becomes an "ON" state for a predetermined time (Tt) in place of the internal busy signal. Therefore, the external busy signal is maintained as it is "ON" state. This considers the following matter that the user has confirmed the printed sheet, and thereafter, carries out an additional print or retry the print.

The timer busy signal generated from the time T08 becomes an "OFF" state when it elapses a predetermined time (Tt). In other words, after the time T09, unless a process operation by the off-line mode is carried out, the internal and timer busy signals both become an "OFF" state. Therefore, the external busy signal shifts to an "OFF" state, so that the intervention is possible by remote control from the external computer system 9.

At the time T10, when another user transmits an instruction to start the stencil making and printing process to the stencil making and printing machine 1 by remote control from the external computer system 9, the stencil making and printing machine 1 is changed into an on-line mode, and then, starts the stencil making and printing process by the on-line mode. In this case, the digital original used for the stencil making and printing process by the on-line mode is received when the internal or timer busy signal is an "ON" state. By doing so, for example, the digital original is previously received for the duration from the time T08 to T09, so that the work can be effectively done. It should be noted that when the digital original used in the on-line mode is received when the internal or timer busy signal is in an "ON" state, the stencil making and printing machine will immediately start the on-line mode upon the busy signal for external output being turned "OFF".

At the time T11, when the stencil making and printing process by the on-line mode is completed, the internal busy signal again becomes an "OFF" state. However, the timer busy signal becomes an "ON" state for a predetermined time (Tt) in place of the internal busy signal. Therefore, the external busy signal is maintained as it is "ON" state. This considers the following matter that the user has confirmed the printed sheet, and thereafter, carries out an additional print or retry the print.

The timer busy signal generated from the time T11 becomes an "OFF" state when it elapses a predetermined time (Tt). In other words, after the time T11, the intervention operation by the off-line mode is possible, and after the time T12, the intervention is possible by remote control from the external computer system 9.

One embodiment of the present invention has been described. The present invention is not limited to the above embodiment, and various modifications and changes may be made within a range of scope from diverging from the gist of the present invention.

For example, in this embodiment, various busy signals have been generated according to the control program stored in the ROM 83. These busy signals may be generated by hardware.

Further, in this embodiment, the personal computer has been used as the external computer system 9, without being limited to this, for example, a word processor, facsimile, information terminal and the like may be used as the external computer system 9.

What is claimed is:

1. A stencil making and printing system, comprising:

a stencil making and printing machine, which carries out a stencil making process and a printing process based on a print information received via a controller; and an external computer system, which transmits the print information to the stencil making and printing machine by remote control via the controller;

the stencil making and printing machine including:

means for generating a busy signal indicative that the stencil making and printing machine is a busy state for a predetermined time after the stencil making process and for a predetermined time after the printing process; and means for limiting an intervention operation from the external computer system by giving the busy signal to the external computer system via the controller from the stencil making and printing machine.

2. A stencil making and printing system, comprising:

a stencil making and printing machine, which carries out a stencil making process and a printing process based on a print information received via a controller; and an external computer system, which transmits the print information to the stencil making and printing machine by remote control via the controller;

the stencil making and printing system having:

an on-line mode of transmitting the print information from the external computer system to the stencil making and printing machine via the controller, and carrying out the stencil making process and the printing process based on the transmitted print information by remote control from the external computer system in the stencil making and printing machine; and an off-line mode of reading the print information from an original by an original reading section included in the stencil making and printing machine, and carrying out the stencil making process and the printing process based the read print information in the stencil making and printing machine;

the stencil making and printing machine including:

means for generating an internal busy signal indicative that internal units of the stencil making and printing machine is a busy state, a timer busy signal indicative that the stencil making and printing machine is the busy state for a predetermined time after the stencil making process and for a predetermined time after the printing process, and an external busy signal generated by the logical sum of the internal and timer busy signals;

means for limiting an operator intervention by the off-line mode by the internal busy signal; and means for limiting an intervention operation from the external computer system by giving the external busy signal as an answer to the external computer system via the controller.

3. A stencil making and printing system according to claim 2, wherein the stencil making and printing machine accepts the transmission of the print information from the external computer system when the internal or timer busy signals are in an "ON" state.

4. A stencil making and printing system according to claim 2, wherein the stencil making and printing machine is shifted to the off-line mode in the case where an original detection means included in the original reading section makes a detection that the original is set on the original reading section.

5. A control method for controlling a stencil making and printing system, the stencil making and printing system carrying out a stencil making process and a printing process by remote control from an external computer system based on a print information transmitted from the external computer system via a controller in a stencil making and printing machine, the control method comprising:

generating a busy signal indicative that the stencil making and printing machine is a busy state for a predetermined time after the stencil making process and for a predetermined time after the printing process; and limiting an intervention operation from the external computer system by giving the busy signal to the external computer system via the controller from the stencil making and printing machine.

6. A control method for controlling a stencil making and printing system, which has an on-line mode of transmitting a print information from an external computer system to a stencil making and printing machine via a controller, and carrying out a stencil making process and a printing process based on the transmitted print information by remote control from the external computer system in the stencil making and printing machine, and an off-line mode of reading a print information from an original by an original reading section included in the stencil making and printing machine, and carrying out the stencil making process and the printing process based on the read print information in the stencil making and printing machine, the control method comprising:

generating an internal busy signal indicative that internal units of the stencil making and printing machine is a busy state; a timer busy signal indicative that the stencil making and printing machine is the busy state for a predetermined time after the stencil making process and for a predetermined time after the printing process, and an external busy signal generated by the logical sum of the internal and timer busy signals;

limiting an operator intervention by the off-line mode by the internal busy signal; and limiting an intervention operation from the external computer system by giving the external busy signal as an answer to the external computer system via the controller from the stencil making and printing machine.

7. A control method according to claim 6, wherein the transmission of the print information from the external computer system to the stencil making and printing machine is possible when the internal or timer busy signals are in an "ON" state.

8. A control method according to claim 6, wherein a process mode of the stencil making and printing machine is shifted to the off-line mode in the case where an original detection means included in the original reading section makes a detection that the original is set on the original reading section.

9. A stencil making and printing machine, receiving a print information from an external computer system via a controller, and carrying out a stencil making process and a printing process based on the received the print information, the stencil making and printing machine comprising:

means for generating a busy signal indicative that the stencil making and printing machine is a busy state for a predetermined time after the stencil making process and for a predetermined time after the printing process; and means for limiting an intervention operation from the external computer system by giving the busy signal to the external computer system via the controller from the stencil making and printing machine.

10. A stencil making and printing machine, which has an on-line mode of transmitting a print information from an external computer system to the stencil making and printing machine via a controller, and carrying out a stencil making process and a printing process based on the transmitted print information by remote control from the external computer system in the stencil making and printing machine, and an off-line mode of reading a print information from an original by an original reading section included in the stencil making and printing machine, and carrying out the stencil making process and the printing process based on the read print information in the stencil making and printing machine, the stencil making and printing machine comprising:

means for generating an internal busy signal indicative that internal units of the stencil making and printing machine is a busy state, a timer busy signal indicative that the stencil making and printing machine is the busy state for a predetermined time after the stencil making process and for a predetermined time after the printing process, and an external busy signal generated by the logical sum of the internal and timer busy signals;

means for limiting an operator intervention by the off-line mode by the internal busy signal; and means for limiting an intervention operation from the external computer system by giving the external busy signal as an answer to the external computer system via the controller.

11. A stencil making and printing machine according to claim 10, wherein the stencil making and printing machine accepts a transmission of the print information from the external computer system when the internal or timer busy signals are in an "ON" state.

12. A stencil making and printing machine according to claim 10, wherein the stencil making and printing machine is shifted to the off-line mode in the case where an original detection means included in the original reading section makes a detection that the original is set on the original reading section.

* * * * *